US009200820B2

(12) United States Patent
Okazaki et al.

(10) Patent No.: US 9,200,820 B2
(45) Date of Patent: Dec. 1, 2015

(54) HEAT PUMP APPARATUS WITH EJECTOR CYCLE

(75) Inventors: Takashi Okazaki, Tokyo (JP); So Nomoto, Tokyo (JP); Shinya Higashiiue, Tokyo (JP); Hirokazu Minamisako, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 916 days.

(21) Appl. No.: 13/499,365

(22) PCT Filed: Oct. 20, 2009

(86) PCT No.: PCT/JP2009/068040

§ 371 (c)(1),
(2), (4) Date: Mar. 30, 2012

(87) PCT Pub. No.: WO2011/048662

PCT Pub. Date: Apr. 28, 2011

(65) Prior Publication Data

US 2012/0180510 A1 Jul. 19, 2012

(51) Int. Cl.

| | |
|---|---|
| ***F25B 41/04*** | (2006.01) |
| ***F25B 13/00*** | (2006.01) |
| *F25B 41/00* | (2006.01) |

(52) U.S. Cl.

CPC ..... *F25B 13/00* (2013.01); *F25B 41/00* (2013.01); *F25B 2341/0011* (2013.01); *F25B 2400/0407* (2013.01); *F25B 2400/13* (2013.01); *F25B 2400/23* (2013.01)

(58) Field of Classification Search

CPC ..... F25B 2341/001; F25B 2341/0011; F25B 2341/0013; F25B 2400/0407

See application file for complete search history.

(56) References Cited

U.S. PATENT DOCUMENTS 6,834,514 B2 12/2004 Takeuchi et al.
6,935,421 B2 * 8/2005 Takeuchi et al. ..... 165/202

(Continued)

FOREIGN PATENT DOCUMENTS

CN 1374491 A 10/2002
CN 1618263 A 5/2005

(Continued)

OTHER PUBLICATIONS

International Search Report (Form PCT/ISA/210) dated Jan. 12, 2010, issued in the corresponding International Application No. PCT/JP2009/068040. (4 pages).

(Continued)

*Primary Examiner* — Jonathan Bradford

(74) *Attorney, Agent, or Firm* — Buchanan Ingersoll & Rooney PC

(57) ABSTRACT

In a heat pump apparatus, switching between high efficiency operation, and high capacity operation, is performed according to the state of the load. A main refrigerant circuit uses an ejector. A first sub-refrigerant circuit connects a portion between a heat exchanger and an ejector to a portion between a gas-liquid separator and a heat exchanger A second sub-refrigerant circuit connects a portion between the heat exchanger and the ejector to an injection pipe of a compressor. When the load is medium, refrigerant is circulated in the main refrigerant circuit to perform an efficient ejector aided operation. When the load is large, a high capacity injection operation is performed by flowing refrigerant to the second sub-refrigerant circuit. When the load is small, a simple bypass operation prevents degradation of efficiency by flowing refrigerant to the first sub-refrigerant circuit.

12 Claims, 12 Drawing Sheets

(56) References Cited

U.S. PATENT DOCUMENTS

| | | | | |
|---|---|---|---|---|
| 2002/0124592 | A1 | 9/2002 | Takeuchi et al. | |
| 2004/0003608 | A1 | 1/2004 | Takeuchi et al. | |
| 2005/0083654 | A1 | 4/2005 | Tsoi | |
| 2007/0271942 | A1* | 11/2007 | Yokoyama et al. | 62/278 |
| 2009/0199581 | A1* | 8/2009 | Ushijima et al. | 62/238.7 |

FOREIGN PATENT DOCUMENTS

| | | | |
|---|---|---|---|
| EP | 2 088 390 | A2 | 8/2009 |
| JP | 58-037457 | A | 3/1983 |
| JP | 58-096955 | A | 6/1983 |
| JP | 61-285352 | A | 12/1986 |
| JP | 01-300167 | A | 12/1989 |
| JP | 2001-066000 | A | 3/2001 |
| JP | 2003-097868 | A | 4/2003 |
| JP | 2004-037057 | A | 2/2004 |
| JP | 2004-163084 | A | 6/2004 |
| JP | 2006-308181 | A | 11/2006 |
| JP | 2008-116124 | A | 5/2008 |
| JP | 2008-241069 | A | 10/2008 |
| JP | 2008-249236 | A | 10/2008 |
| JP | 2009-186121 | A | 8/2009 |

OTHER PUBLICATIONS

Office Action dated Aug. 28, 2012, issued by the Japanese Patent Office in the corresponding Japanese Patent Application No. 2011-537045 and an English translation thereof. (4 pages).

Office Action dated Apr. 2, 2013, issued by the Japanese Patent Office in the corresponding Japanese Patent Application No. 2011-537045, and partial English translation thereof. (5 pages).

Office Action issued on Dec. 17, 2013, by the Chinese Patent Office in corresponding Chinese Patent Application No. 200980162048.X and an English translation of the Office Action. (13 pages).

* cited by examiner

HEAT PUMP APPARATUS WITH EJECTOR CYCLE

TECHNICAL FIELD

The present invention relates to a heat pump apparatus equipped with an ejector, for example.

BACKGROUND ART

In Patent Literature 1, there is disclosed an air conditioning apparatus that performs switching, depending on the situation, between a power recovery operation utilizing an ejector and a decompression operation using a general expansion valve, without using the ejector.

In this air conditioning apparatus, the operation is switched from the power recovery operation to the decompression operation when pressure decreases at the high pressure side. Thereby, it is possible to inhibit the efficiency degradation due to shortage of the amount of refrigerant circulated to the evaporator caused by shortage of driving force of the ejector.

CITATION LIST

Patent Literature

Patent Literature 1: Japanese Unexamined Patent Publication No. 2008-116124

SUMMARY OF INVENTION

Technical Problem

In the air conditioning apparatus disclosed in the Patent Literature 1, when the load is low, such as the case of performing a heating operation in a high outdoor temperature, degradation of efficiency can be inhibited. However, when the load is high, such as the case of performing a heating operation in a low outdoor temperature, it is impossible to perform an operation with high capacity.

An object of the present invention is to provide a heat pump apparatus which, according to the state of the load, is capable of switching between high efficiency operation, being efficient, and high capacity operation, having high capacity. Particularly, the present invention aims to provide a heat pump apparatus having a circuit configuration that can efficiently perform both the high efficiency operation and the high capacity operation.

Solution to Problem

A heat pump apparatus according to the present invention, for example, includes:

a main refrigerant circuit, through which refrigerant circulates, configured by connecting a discharge side of a compressor and one mouth of a first heat exchanger by piping, other mouth of the first heat exchanger and a first inlet of an ejector by piping, an outlet of the ejector and an inlet of a gas-liquid separator by piping, a gas side outlet of the gas-liquid separator and an intake side of the compressor by piping, a liquid side outlet of the gas-liquid separator and one mouth of a second heat exchanger by piping, and other mouth of the second heat exchanger and a second inlet of the ejector by piping;

a first sub-refrigerant circuit configured by connecting by piping a first connection point between the other mouth of the first heat exchanger and the first inlet of the ejector in the main refrigerant circuit to a second connection point between the liquid side outlet of the gas-liquid separator and the one mouth of the second heat exchanger in the main refrigerant circuit, and being provided with a first expansion mechanism in middle of the piping;

a second sub-refrigerant circuit that makes a part of refrigerant flowing through a third connection point between the other mouth of the first heat exchanger and the first inlet of the ejector in the main refrigerant circuit bypass the ejector so as to flow into the compressor, and is provided in its middle with a second expansion mechanism, and a third heat exchanger that performs heat exchange between refrigerant flowing between the first connection point and the first expansion mechanism in the first sub-refrigerant circuit and refrigerant after passing through the second expansion mechanism in the second sub-refrigerant circuit.

Advantageous Effects of Invention

The heat pump apparatus according to the present invention includes a main refrigerant circuit that utilizes an ejector, and two sub-refrigerant circuits that bypass the ejector. It is possible to perform switching between the high efficiency operation and the high capacity operation by, according to the state of the load, switching the circuit through which the refrigerant flows. Moreover, since the branching positions of the main refrigerant circuit and the two sub-refrigerant circuits, the installation position of the third heat exchanger, and the like are optimized, both the high efficient operation and the high capacity operation can be operated efficiently.

DESCRIPTION OF EMBODIMENTS

Embodiment 1

First, the structure of a heat pump apparatus 100 according to Embodiment 1 will be explained.

Figure 1:
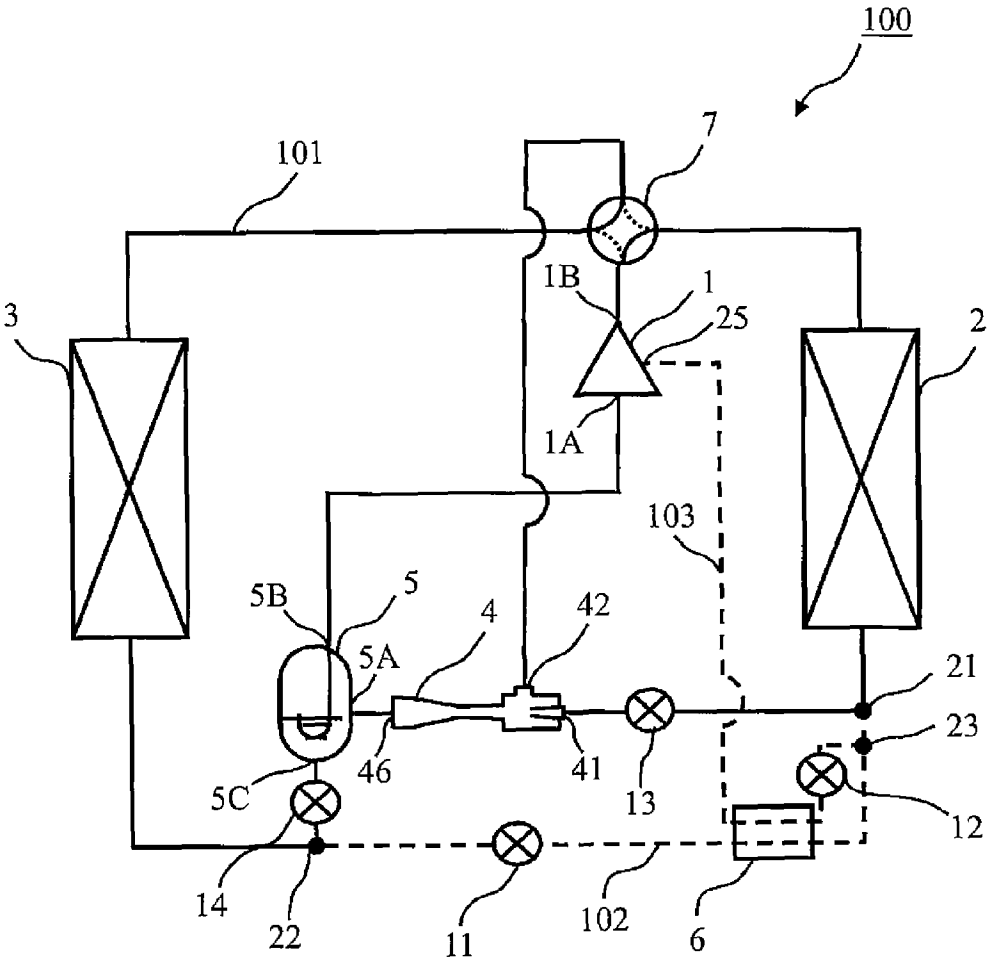
FIG. 1 shows a block diagram of a heat pump apparatus 100 according to Embodiment 1.

FIG. 1 shows a block diagram of the heat pump apparatus 100 according to Embodiment 1.

As shown in FIG. 1, the heat pump apparatus 100 includes a main refrigerant circuit 101 represented by a solid line, and sub-refrigerant circuits 102 and 103 represented by dashed lines.

In the main refrigerant circuit 101, a discharge port 1B of a compressor 1 and a heat exchanger 2 (first heat exchanger) are connected by piping through a four-way valve 7. The heat exchanger 2 and a first inlet 41 of an ejector 4 are connected by piping. An outlet 46 of the ejector 4 and an inlet 5A of a gas-liquid separator 5 are connected by piping. A gas side outlet 5B of the gas-liquid separator 5 and a suction port 1A of the compressor 1 are connected by piping. A liquid side outlet 5C of the gas-liquid separator 5 and a heat exchanger 3 (second heat exchanger) are connected by piping. The heat exchanger 3 and a second inlet 42 of the ejector 4 are connected by piping through the four-way valve 7.

The four-way valve 7 performs switching between a first flow path (flow path of the solid line in the four-way valve 7 of FIG. 1) and a second flow path (flow path of the dashed line in the four-way valve 7 of FIG. 1). The first flow path connects the discharge port 1B of the compressor 1 and the heat exchanger 2, and also connects the heat exchanger 3 and the second inlet 42 of the ejector 4. On the other hand, the second flow path connects the discharge port 1B of the compressor 1 and the heat exchanger 3, and also connects the heat exchanger 2 and the second inlet 42 of the ejector 4.

In the main refrigerant circuit 101, there is provided a third expansion valve 13 (on-off valve), which is an electronic expansion valve, in the pipe between a branch point 21 (first connection point, and third connection point) to be described later and the first inlet 41 of the ejector 4. Moreover, in the main refrigerant circuit 101, there is provided a fourth expansion valve 14 (on-off valve), which is an electronic expansion valve, in the pipe between the liquid side outlet 5C of the gas-liquid separator 5 and a junction point 22 (second connection point) to be described later.

In addition, an HFC (hydrofluorocarbon) group refrigerant R410 or a natural refrigerant, such as propane and $CO_2$, is enclosed in the main refrigerant circuit 101.

The sub-refrigerant circuits 102 and 103 are provided such that their pipe branches from the main refrigerant circuit 101, at the branch point 21 between the heat exchanger 2 and the first inlet 41 of the ejector 4. The sub-refrigerant circuits 102 and 103 are branched at a branch point 23 into a first sub-refrigerant circuit 102 and a second sub-refrigerant circuit 103.

The first sub-refrigerant circuit 102 connects piping from the branch point 23 to the junction point 22 which is between the liquid side outlet 5C of the gas-liquid separator 5 and the heat exchanger 3 in the main refrigerant circuit 101. In the first sub-refrigerant circuit 102, there is provided a first expansion valve 11 (first expansion mechanism), which is an electronic expansion valve, in the middle of the piping.

The second sub-refrigerant circuit 103 connects from the branch point 23 to an injection pipe 25 provided at the compressor 1. In the second sub-refrigerant circuit 103, there is provided a second expansion valve 12 (second expansion mechanism), which is an electronic expansion valve, in the middle of the piping.

The injection pipe 25 is connected to the intermediate pressure space in the compressor 1. The intermediate pressure space is a space where, when the compressor 1 compresses the refrigerant sucked in through the suction port 1A from a low pressure to a high pressure, the pressure of the refrigerant sucked in through the suction port 1A turns into an intermediate pressure higher than the low pressure and lower than the high pressure in the compressor 1. That is, the intermediate pressure space is a space where the refrigerant sucked in through the suction port 1A turns into an intermediate state of compression in the compressor 1. For example, in the case of a two-stage compressor in which a low stage compression unit and a high stage compression unit are connected in series, the flow path connecting the low stage compression unit and the high stage compression unit is an intermediate pressure space. In the case of a single-stage compressor in which refrigerant sucked in through the suction port is compressed from a low pressure to a high pressure in one compression unit, the intermediate pressure space is a space in the compression unit (in the compression chamber) where the pressure of refrigerant sucked in through the suction port is an intermediate pressure. Thus, the second sub-refrigerant circuit 103 is a so-called injection circuit.

The heat pump apparatus 100 includes a third heat exchanger 6 (sub-cooler) that performs heat exchange between the refrigerant which flows between the branch point 23 and the first expansion valve 11 in the first sub-refrigerant circuit 102 and the refrigerant which flows between the second expansion valve 12 and the injection pipe 25 in the second sub-refrigerant circuit 103.

Figure 2:
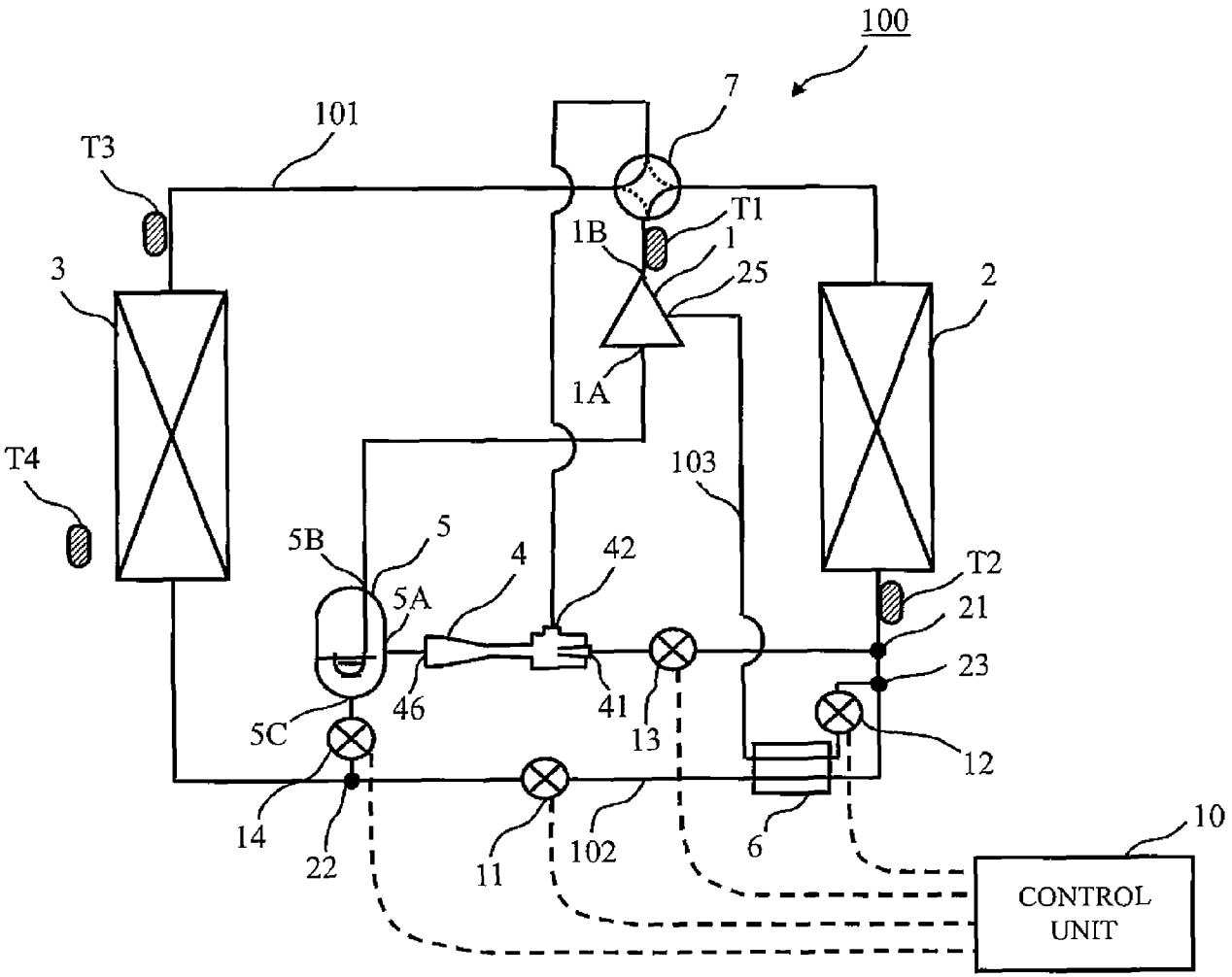
FIG. 2 shows an explanatory diagram of a control unit 10 of the heat pump apparatus 100.

FIG. 2 is an explanatory diagram of a control unit 10 of the heat pump apparatus 100.

As shown in FIG. 2, the heat pump apparatus 100 includes temperature sensors T1, T2, T3, and T4, and the control unit 10.

The temperature sensor T1 detects a refrigerant temperature at the discharge side of the compressor 1.

The temperature sensor T2 detects a refrigerant temperature at the outlet side of the heat exchanger 2 in the heating operation. That is, the temperature sensor T2 detects a degree of subcoolinq, of the refrigerant in the heating operation.

The temperature sensor T3 detects a refrigerant temperature at the outlet side of the heat exchanger 3 in the heating operation. That is, the temperature sensor T3 detects a degree of superheating of the refrigerant in the heating operation.

The temperature sensor T4 detects an outdoor temperature.

The control unit 10 controls opening degrees of the expansion valves 11, 12, 13, and 14 according to the temperatures detected by the temperature sensors T1, T2, T3, and T4. For example, the control unit 10 controls the second expansion valve 12 according to the outdoor temperature detected by the temperature sensor T4 and the refrigerant temperature detected by the temperature sensor T1. Moreover, the control unit 10 controls the third expansion valve 13 according to the outdoor temperature detected by the temperature sensor T4 and the refrigerant temperature detected by the temperature sensor T2. Further, the control unit 10 controls the first expansion valve 11 and the fourth expansion valve 14 according to the outdoor temperature detected by the temperature sensor T4 and the refrigerant temperature detected by the temperature sensor T3.

Furthermore, the control unit 10 controls the setting of the four-way valve 7 according to the contents of the operation, such as a heating operation, a cooling operation, and a defrosting operation.

The control unit 10 is a computer, such as a microcomputer.

Next, the structure and operation of the ejector 4 will be explained.

Figure 3:
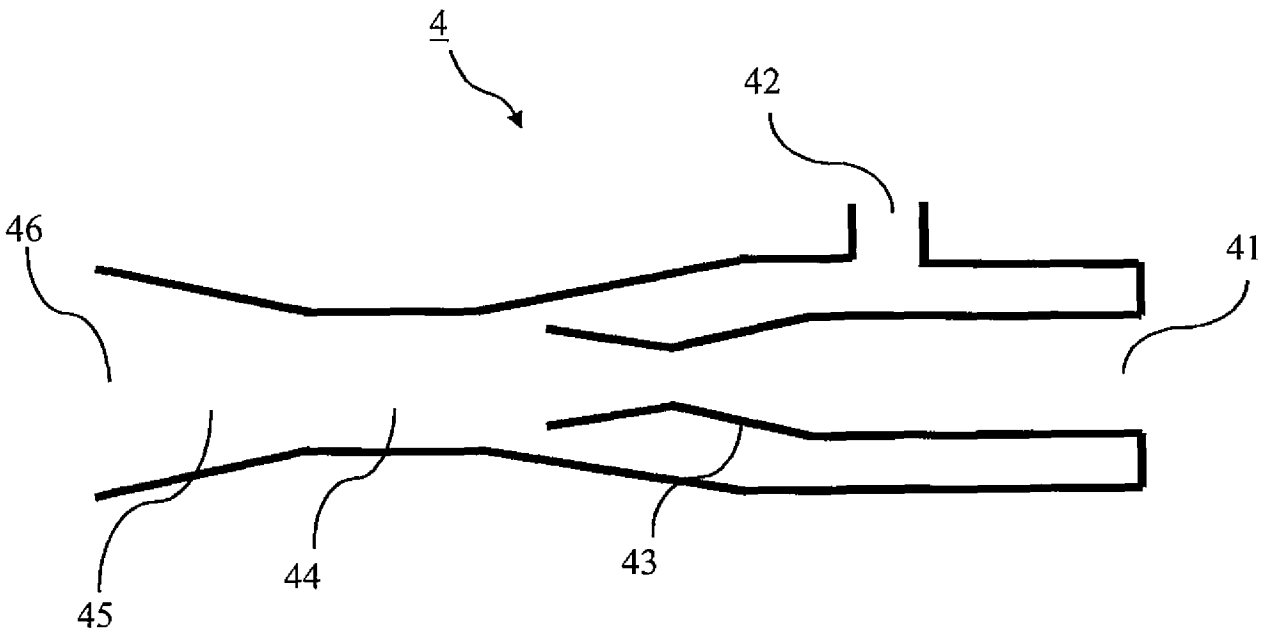
FIG. 3 shows a structure diagram of an ejector 4.

FIG. 3 is a structure diagram of the ejector 4.

As shown in FIG. 3, the ejector 4 includes two inlets, that is the first inlet 41 and the second inlet 42, and one outlet 46. Moreover, the ejector 4 includes a nozzle section 43, a mixing section 44, and a diffuser section 45. The mixing section 44 and the diffuser section 45 are generically called a pressure boosting section.

High-pressure liquid refrigerant serving as a driving flow flows in through the first inlet 41. Refrigerant which flowed in through the first inlet 41 is decompressed/expanded and accelerated in the nozzle section 43, and jetted to the mixing section 44. That is, the nozzle section 43 decompresses/expands the refrigerant by isentropically converting the pressure energy of the refrigerant to kinetic energy, and jets it to the mixing section 44.

The refrigerant is sucked into the mixing section 44 through the second inlet 42 by the entrainment action of the high-speed refrigerant flow jetted from the nozzle section 43 to the mixing section 44. In the mixing section 44, the refrigerant jetted from the nozzle section 43 and the refrigerant sucked in through the second inlet 42 are mixed. At this time, as the refrigerant is mixed such that the sum of the kinetic energy of the refrigerant jetted from the nozzle section 43 and the kinetic energy of the refrigerant sucked in through the second inlet 42 is preserved, the pressure of the refrigerant increases in the mixing section 44, thereby the refrigerant turning into a gas-liquid two phase.

The flow path cross-sectional area of the diffuser section 45 gradually enlarges from the mixing section 44 side to the outlet 46 side. Therefore, in the diffuser section 45, the speed energy of the refrigerant which flowed in from the mixing section 44 side is converted into pressure energy, and the pressure increases. Then, the refrigerant flows out of the outlet 46.

Now, effect of the ejector cycle utilizing the ejector 4 will be explained.

Figure 4:
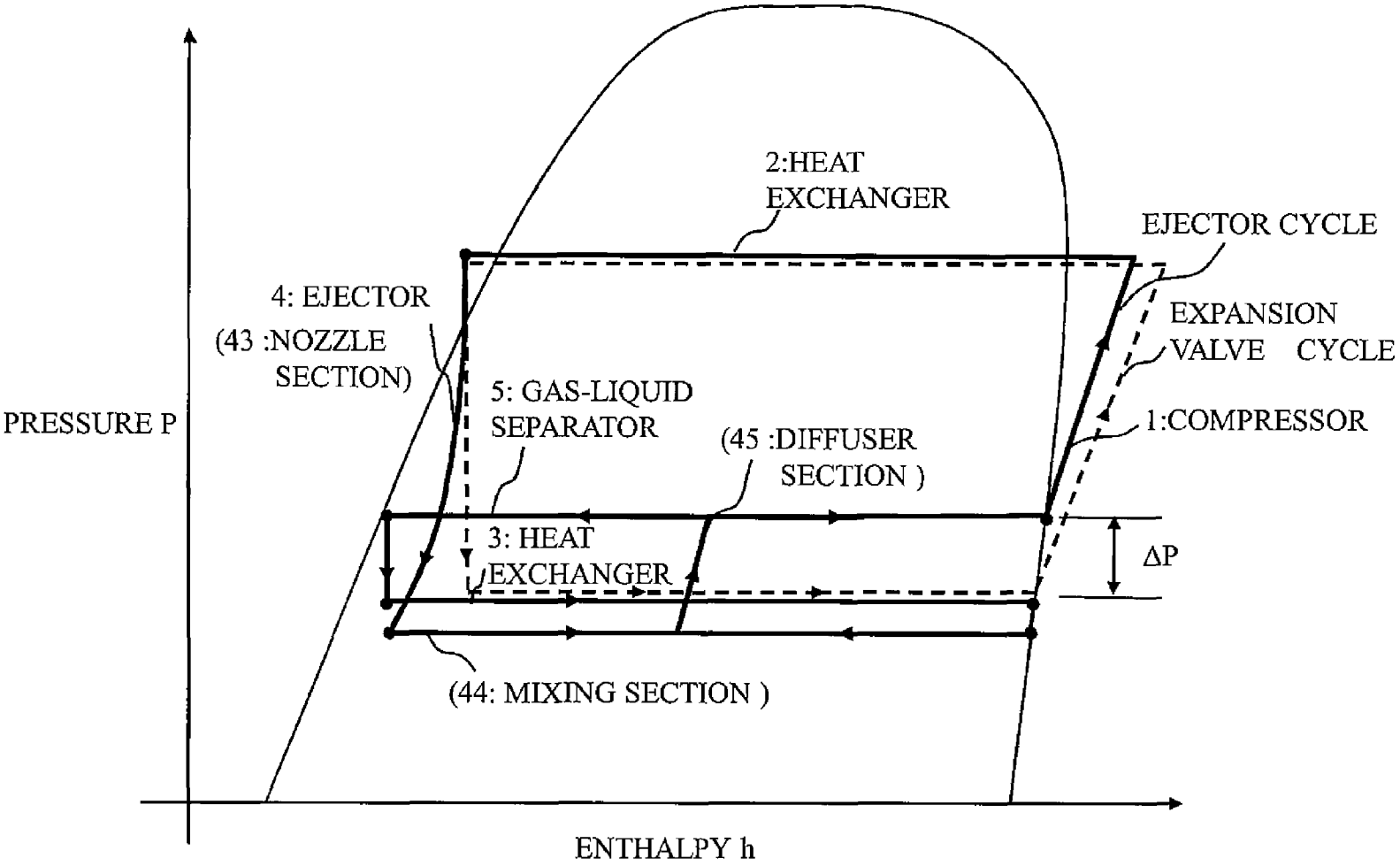
FIG. 4 shows a P-h diagram of an ejector cycle.

FIG. 4 is a P-h diagram of an ejector cycle. In FIG. 4, the solid line indicates an ejector cycle and the dashed line indicates a general expansion valve cycle. The general expansion valve cycle is a heat pump cycle in which a compressor, a condenser, an expansion valve, and an evaporator are connected by piping in series.

As shown in FIG. 4, in the ejector cycle, a high-temperature high-pressure refrigerant discharged from the compressor 1 radiates heat and is cooled in the heat exchanger 2 and flows into the ejector 4 through the first inlet 41. As described above, the refrigerant having flowed into the ejector 4 through the first inlet 41 is decompressed and expanded in the nozzle section 43. Moreover, the low temperature refrigerant jetted from the nozzle section 43 is mixed with the high temperature refrigerant flowed out of the heat exchanger 3 in the mixing section 44, and its temperature increases. Furthermore, the refrigerant is pressure-boosted in the diffuser section 45, and flows into the gas-liquid separator 5 to be separated into gas and liquid. A gaseous refrigerant separated in the gas-liquid separator 5 is sucked in into the compressor 1, and a liquid refrigerant flows into the heat exchanger 3.

By such operation, the pressure of the refrigerant sucked in by the compressor 1 in the ejector cycle is higher by $\Delta P$ than that of the refrigerant sucked in by the compressor in the general expansion valve cycle. Since the pressure of the refrigerant sucked in by the compressor 1 is higher by $\Delta P$, the power to be supplied to the compressor 1 can be reduced by as much as $\Delta P$, thereby increasing the COP (Coefficient of Capacity).

The ejector 4 is a two phase flow ejector including the nozzle section 43, the mixing section 44, and the diffuser section 45 as described above. The dimension of each part of the ejector 4 is tuned and designed to be optimal, based on high and low pressures and a circulation flow rate under the load (for example, outdoor temperature being higher than or equal to 2° C. and lower than 7° C.) in the heat pump cycle.

In the expansion valve generally used, pressure energy is lost when the refrigerant is expanded. On the other hand, in the ejector 4, as described above, when the refrigerant is expanded in the nozzle section 43, the pressure energy of the refrigerant is converted to kinetic energy, and further, the kinetic energy is converted to pressure energy in the mixing section 44 and the diffuser section 45. By this, a part of pressure energy loss is recovered.

Next, the operation of the heat pump apparatus 100 according to Embodiment 1 will be explained. Here, heating operation is explained as an example. The heating operation described herein includes not only heating the air in a room but also heating water for supplying hot water.

FIGS. 5 to 8 show a flow of the refrigerant in each operation state in the heat pump apparatus 100. The arrows in FIGS. 5 to 8 represent flows of the refrigerant. Moreover, the parenthesized "open" or "closed" shown beside the reference sign of the expansion valve 11, 12, 13, or 14 represents an opening degree of the expansion valves 11, 12, 13, or 14. If it is "open", it represents a state where the opening degree of the expansion mechanism concerned is larger than a predetermined opening degree and the refrigerant is in a flowing state. If it is "closed", it represents a state where the opening degree of the expansion mechanism concerned is smaller (for example, closed completely) than a predetermined opening degree and the refrigerant is not in a flowing state. Moreover, the circuit shown in a solid line represents a circuit through which the refrigerant flows, and the circuit shown in a dashed line represents a circuit through which the refrigerant does not flow.

First, the case of performing an ejector aided operation utilizing the ejector 4 will be explained. The ejector aided operation is performed when the load is about medium. Concerning the load, it will be described in detail later. The case of the load being medium indicates the case where the outdoor temperature is higher than or equal to 2° C. and lower than 7° C., for example. "Outdoor temperature being higher than or equal to 2° C. and lower than 7° C." is a standard temperature zone in an annual heating operation, and this temperature zone accounts for about half of the entire heating operation time. Therefore, increasing the operation efficiency (COP) in this temperature zone makes it possible to contribute most to improvement in efficiency of all the operations and thus to greatly reduce the electric power annually consumed by the heat pump apparatus. Although the ejector 4 is used for increasing the COP, since the effect of the ejector 4 cannot be derived if the high-pressure side pressure of the heat pump apparatus does not have a certain amount of height, the ejector 4 is not used at the temperature (in this case, higher than or equal to 7° C.) where the heating load is low.

Figure 5:
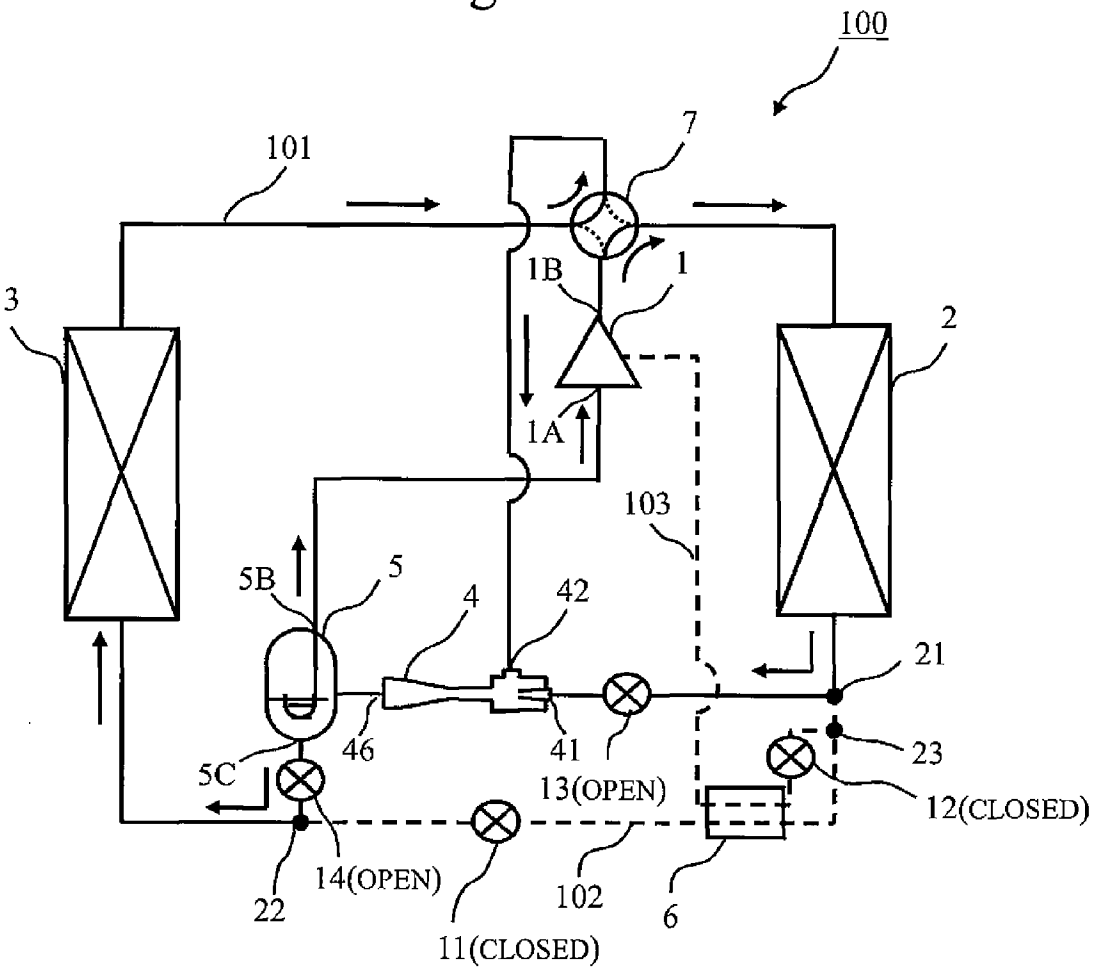
FIG. 5 shows a flow of refrigerant when performing an ejector aided operation.

FIG. 5 shows the flow of the refrigerant in the case of performing an ejector aided operation.

When the load is about medium, the control unit 10 sets the first expansion valve 11 and the second expansion valve 12 to be fully closed, and the third expansion valve 13 and the fourth expansion valve 14 to be open larger than a predetermined opening degree so that a suitable amount of refrigerant may flow therethrough. Moreover, the control unit 10 sets the four-way valve 7 as the first flow path (the flow path shown in a solid line in the four-way valve 7 of FIG. 5).

In such a case, a high-temperature high-pressure gaseous refrigerant discharged from the compressor 1 radiates heat and condenses in the heat exchanger 2 so as to be liquefied to be a medium-temperature high-pressure liquid refrigerant. That is, the heat exchanger 2 operates as a radiator (condenser) in the heating operation. As described above, the heating operation includes not only heating the air in a room but also heating water for supplying hot water. Therefore, the heat exchanger 2 may perform a heat exchange between the refrigerant and the air, or between the refrigerant and the water. Then, all of the medium-temperature high-pressure liquid refrigerant flows toward the ejector 4 side from the branch point 21, and flows into the ejector 4 through the first inlet 41.

As explained based on FIG. 3, the refrigerant which flowed into the ejector 4 through the first inlet 41 is decompressed and accelerated in the nozzle section 43, and jetted to the mixing section 44. The refrigerant jetted to the mixing section 44 is mixed with the refrigerant gas flowing in through the second inlet 42, and turns into gas-liquid two phase since the pressure increases to some extent. Then, the pressure of the gas-liquid two phase refrigerant further increases in the diffuser section 45 to be flowed out of the outlet 46 of the ejector 4.

The refrigerant having flowed out of the ejector 4 flows into the gas-liquid separator 5. The gas-liquid two phase refrigerant which has flowed in the gas-liquid separator 5 is separated into liquid refrigerant and gaseous refrigerant. The separated gaseous refrigerant flows out of the gas side outlet 5B to be sucked in by the compressor 1. Moreover, an oil return hole, which is not shown, is provided in the U-tube configuring the gas side outlet 5B, and oil accumulated in the gas-liquid separator 5 is returned to the compressor 1. On the other hand, after flowing out of the liquid side outlet 5C and being decompressed by the fourth expansion valve 14, the separated liquid refrigerant takes heat from the air in the heat exchanger 3 to be evaporated and turned into a gaseous refrigerant. That is, the heat exchanger 3 operates as an evaporator in the heating operation. The gaseous refrigerant, which has flowed out of the heat exchanger 3, is sucked in to the mixing section 44 through the second inlet 42 of the ejector 4 and mixed with the refrigerant jetted from the nozzle section 43 as described above.

Then, the refrigerant having been sucked in the compressor 1 is compressed to be a high-temperature high-pressure gaseous refrigerant to be discharged and flowed into the heat exchanger 2 again.

In the ejector aided operation, by recovering pressure energies which are lost in the general expansion valve by utilizing the ejector 4, the pressure of the refrigerant to be sucked in by the compressor 1 increases. Therefore, the efficiency of the heat pump apparatus 100 is enhanced.

Next, the case of performing an injection operation without using the ejector 4 will be explained. The injection operation is executed when heating capacity is deficient along with that the outdoor temperature becomes low and heating capacity higher than that of the ejector aided operation is needed. That is, the injection operation is performed when the load is large. The case of the load being large indicates the case where the outdoor temperature is lower than 2° C., for example.

Figure 6:
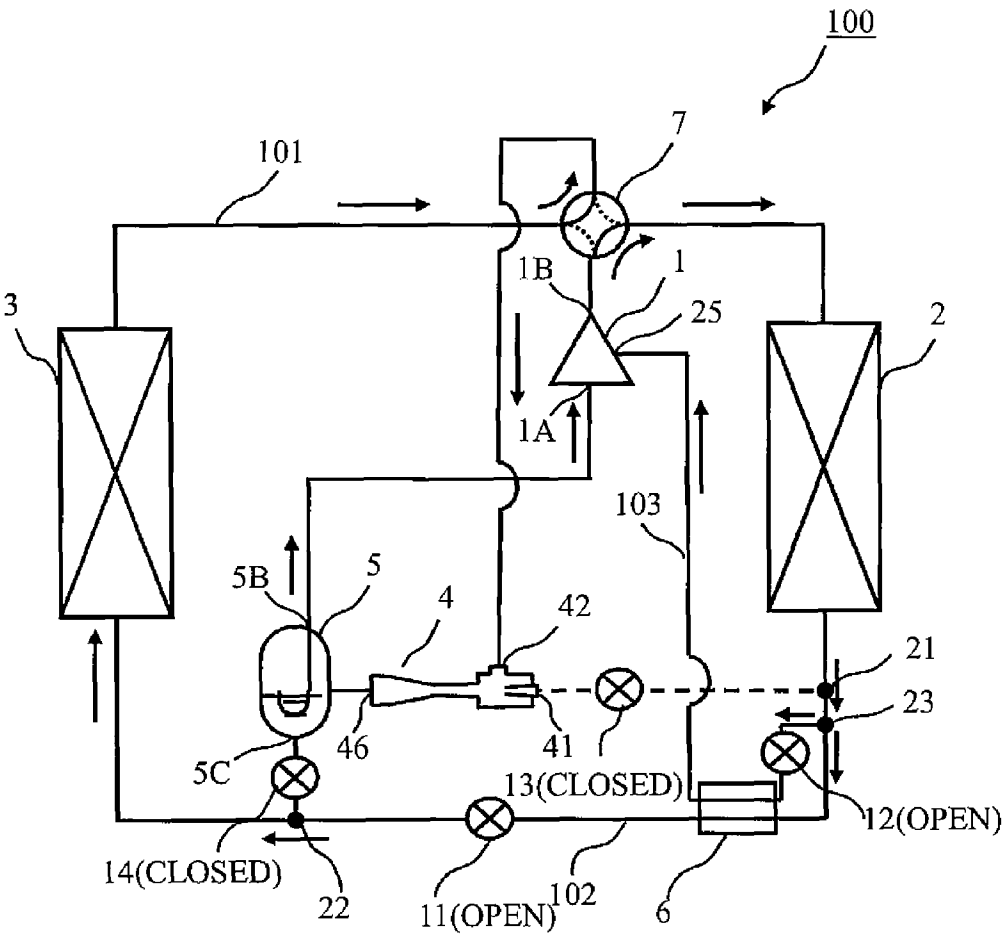
FIG. 6 shows a flow of refrigerant when performing an injection operation.

FIG. 6 shows the flow of the refrigerant in the case of performing an injection operation.

When the load is large, the control unit 10 sets the third expansion valve 13 and the fourth expansion valve 14 to be fully closed, and the first expansion valve 11 and the second expansion valve 12 to be open larger than a predetermined opening degree such that a suitable amount of refrigerant flows therethrough. For example, the control unit 10 adjusts the flow amount of the refrigerant by controlling the opening degree of the first expansion valve 11 so that a super heat at the outlet of the heat exchanger 3 may become higher than or equal to 5° C. and lower than 10° C. Moreover, the control unit 10 adjusts the flow amount of the refrigerant by controlling the opening degree of the second expansion valve 12 so that a discharge temperature of the compressor 1 may become a suitable temperature not exceeding a predetermined temperature. Moreover, the control unit 10 sets the four-way valve 7 in the first flow path (the flow path shown in the solid line in the four-way valve 7 of FIG. 6).

In such a case, as well as the case of the ejector aided operation, the high-temperature high-pressure gaseous refrigerant discharged from the compressor 1 radiates heat and condenses in the heat exchanger 2 so as to be liquefied to be a medium-temperature high-pressure liquid refrigerant. Then, all of the medium-temperature high-pressure liquid refrigerant flows into the sub-refrigerant circuits 102 and 103 from the branch point 21, not flowing to the ejector 4 side. A part of the refrigerant flowing through the sub-refrigerant circuits 102 and 103 is distributed at the branch point 23 to the first sub-refrigerant circuit 102, and the rest is distributed to the second sub-refrigerant circuit 103.

The refrigerant distributed to the second sub-refrigerant circuit 103 is expanded by the second expansion valve 12 and turns into a gas-liquid two phase refrigerant. The refrigerant expanded by the second expansion valve 12 and flowing through the second sub-refrigerant circuit 103, and the refrigerant flowing through the first sub-refrigerant circuit 102 are heat-exchanged in the third heat exchanger 6, and thereby the refrigerant flowing through the second sub-refrigerant circuit 103 is heated and the refrigerant flowing through the first sub-refrigerant circuit 102 is cooled.

The refrigerant having been cooled by the third heat exchanger 6 and flowing through the first sub-refrigerant circuit 102 is expanded by the first expansion valve 11 and flows into the heat exchanger 3. The refrigerant having flowed into the heat exchanger 3 takes heat from the air in the heat exchanger 3 to be evaporated and turned into a gaseous refrigerant. The gaseous refrigerant flowed out of the heat exchanger 3 flows into the gas-liquid separator 5, passing through the second inlet 42, the mixing section 44 and the diffuser section 45 of the ejector 4. The refrigerant having flowed into the gas-liquid separator 5 does not flow out from the liquid side outlet 5C since the fourth expansion valve 14 is closed, but flows out from the gas side outlet 5B to be sucked into the compressor 1 to be compressed.

On the other hand, the refrigerant having been heated by the third heat exchanger 6 and flowing through the second sub-refrigerant circuit 103 is injected into the intermediate pressure space in the compressor 1 through the injection pipe 25.

In the injection operation, the refrigerant which flowed out of the heat exchanger 2 (condenser) is injected into the intermediate pressure space of the compressor 1. Consequently, the circulation amount of the refrigerant increases and the heating capacity is enhanced.

Next, the case of performing a simple bypass operation which does not use the ejector 4 nor performs the injection operation will be explained. The simple bypass operation is performed when the load is small. The case of the load being small indicates the case where the outdoor temperature is higher than or equal to 7° C., for example.

Figure 7:
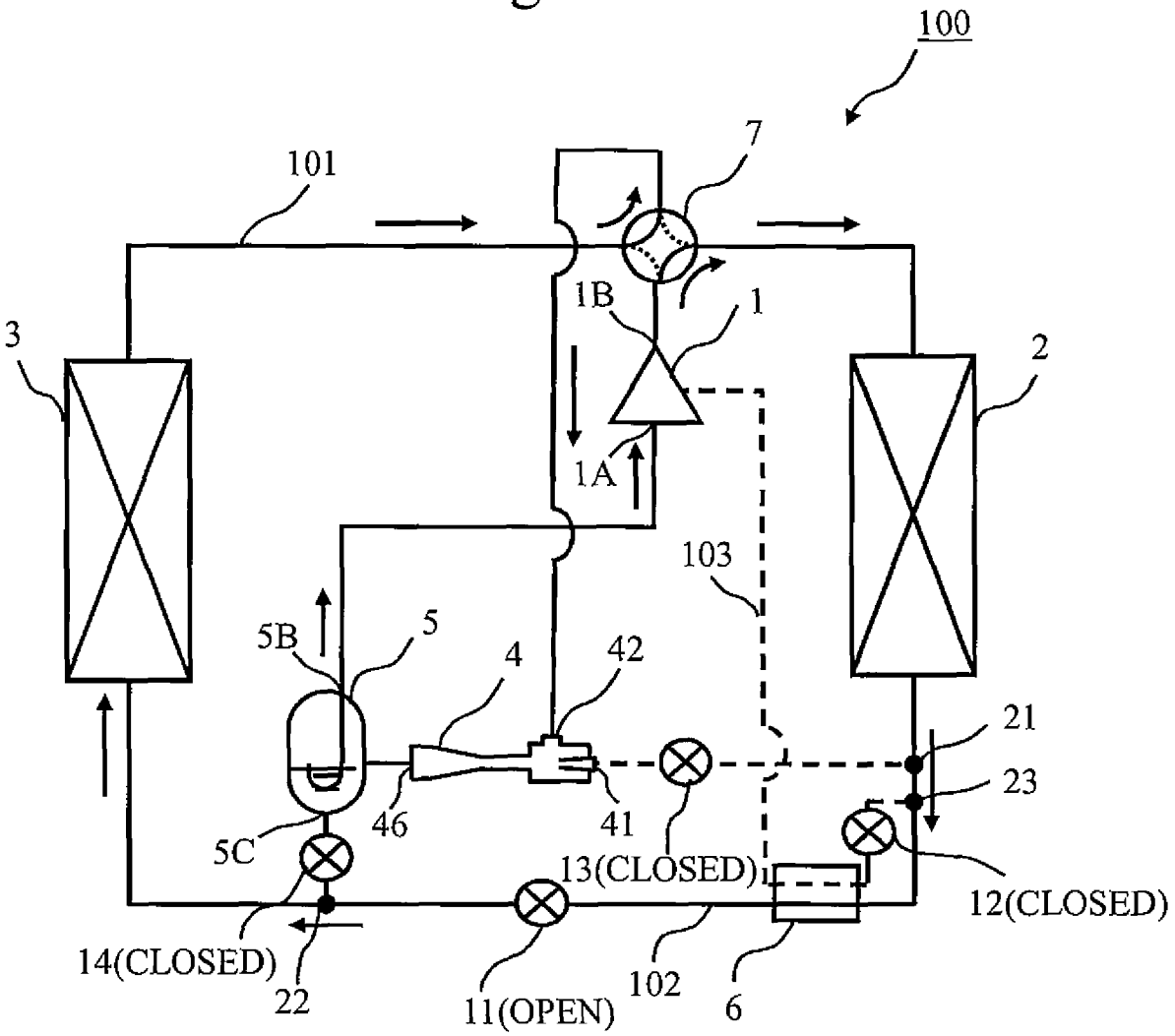
FIG. 7 shows a flow of refrigerant when performing a simple bypass operation.

FIG. 7 shows the flow of the refrigerant in the case of performing a simple bypass operation.

When the load is small, the control unit 10 sets the second expansion valve 12, the third expansion valve 13, and the fourth expansion valve 14 to be fully closed, and the first expansion valve 11 to be open larger than a predetermined opening degree so that a suitable amount of refrigerant may flow therethrough. For example, the control unit 10 adjusts the flow amount of the refrigerant by controlling the opening degree of the first expansion valve 11 so that a super heat at the outlet of the heat exchanger 3 may become higher than or equal to 5° C. and lower than 10° C. Moreover, the control unit 10 sets the four-way valve 7 in the first flow path (the flow path shown in the solid line in the four-way valve 7 of FIG. 7).

In such a case, as well as the case of the ejector aided operation, the high-temperature high-pressure gaseous refrigerant discharged from the compressor 1 radiates heat and condenses in the heat exchanger 2 so as to be liquefied to be a medium-temperature high-pressure liquid refrigerant. Then, all of the medium-temperature high-pressure liquid refrigerant flows into the sub-refrigerant circuits 102 and 103 from the branch point 21, not flowing to the ejector 4 side. All of the refrigerant having flowed into the sub-refrigerant circuits 102 and 103 is led, at the branch point 23, to the first sub-refrigerant circuit 102 side. The refrigerant flowing through the first sub-refrigerant circuit 102 is expanded by the first expansion valve 11, and flows into the heat exchanger 3. The refrigerant having flowed into the heat exchanger 3 takes heat from the air in the heat exchanger 3 to be evaporated and turned into a gaseous refrigerant. The gaseous refrigerant flowed out of the heat exchanger 3 flows into the gas-liquid separator 5, passing through the second inlet 42, the mixing section 44 and the diffuser section 45 of the ejector 4. The refrigerant having flowed into the gas-liquid separator 5 does not flow out from the liquid side outlet 5C since the fourth expansion valve 14 is closed, but flows out from the gas side outlet 5B to be sucked into the compressor 1 to be compressed.

That is, a general heating operation is performed in the simple bypass operation.

When the load is low, the pressure at the high pressure side becomes low. That is, the pressure of the refrigerant which flows in through the first inlet 41 becomes low. Therefore, a sufficient driving force cannot be obtained in the nozzle section 43, and refrigerant cannot be sufficiently sucked in through the second inlet 42 in the mixing section 44. As a result, the amount of refrigerant circulated to the heat exchanger 3 (evaporator) decreases, and the efficiency becomes degraded. However, in the simple bypass operation, by bypassing without using the ejector 4, it becomes possible to prevent the amount of refrigerant circulated to the heat exchanger 3 from decreasing, and thereby degradation of the efficiency can be inhibited.

Next, a defrosting operation will be explained. In the case of performing a heating operation in a low outdoor temperature, since the heat exchanger 3 is frosted, the defrosting operation needs to be executed.

Figure 8:
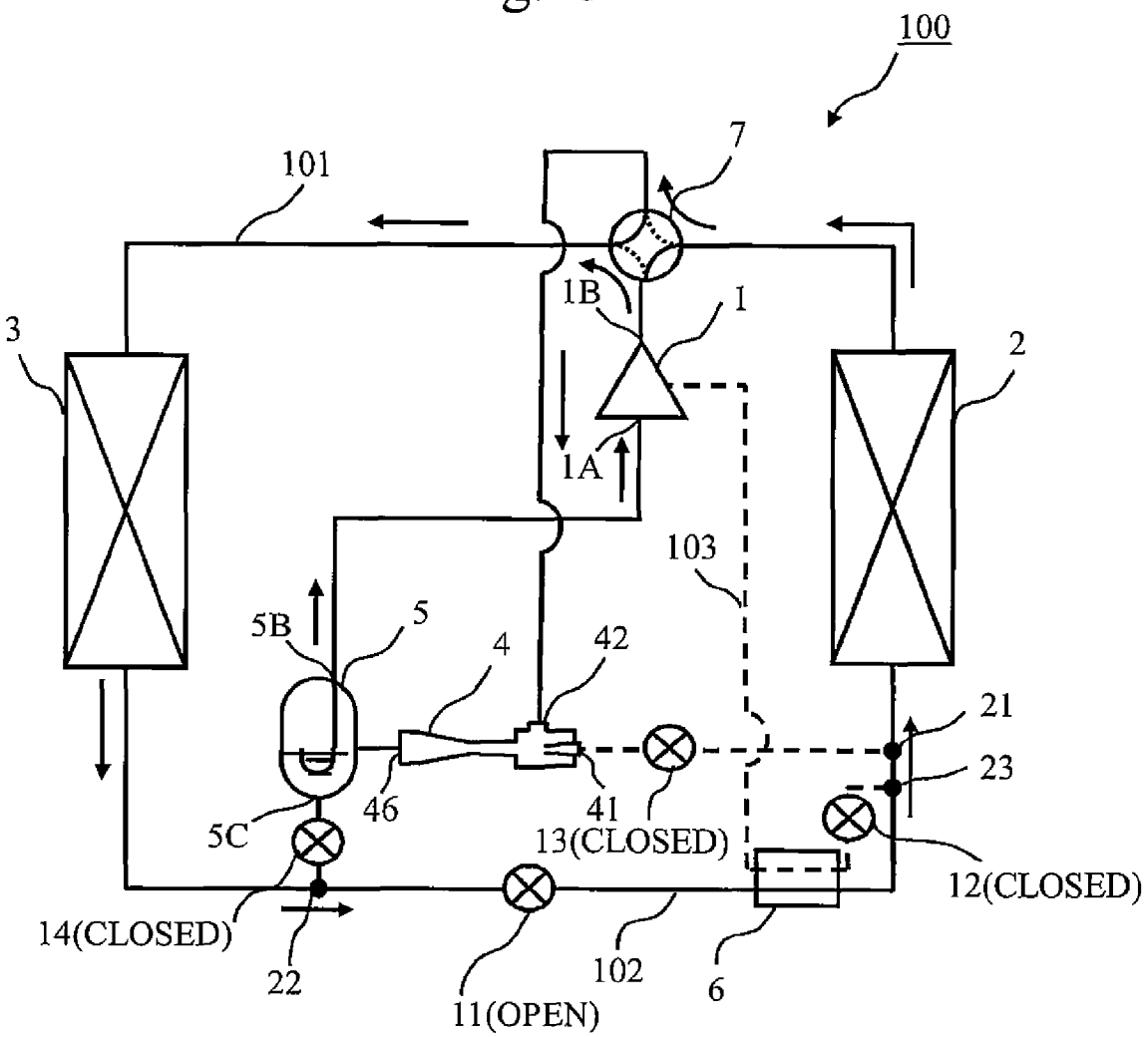
FIG. 8 shows a flow of refrigerant when performing a defrosting operation.

FIG. 8 shows the flow of the refrigerant in the case of performing a defrosting operation.

When performing the defrosting operation, the control unit 10 sets the second expansion valve 12, the third expansion valve 13, and the fourth expansion valve 14 to be fully closed, and the first expansion valve 11 to be open larger than a predetermined opening degree so that a suitable amount of refrigerant may flow therethrough. For example, the control unit 10 adjusts the flow amount of the refrigerant by controlling the opening degree of the first expansion valve 11 so that a super heat at the outlet of the heat exchanger 2 may become higher than or equal to 5° C. and lower than 10° C. Moreover, the control unit 10 sets the four-way valve 7 in the second flow path (the flow path shown in the dashed line in the four-way valve 7 of FIG. 8).

In such a case, the high-temperature high-pressure gaseous refrigerant discharged from the compressor 1 radiates heat to the air and condenses in the heat exchanger 3 so as to be liquefied to be a high pressure liquid refrigerant. At this time, the frost formed on the heat exchanger 3 is melted. That is, the heat exchanger 3 operates as a radiator (condenser) in the defrosting operation. The liquid refrigerant flowed out of the heat exchanger 3 is decompressed by the first expansion valve 11. The refrigerant decompressed by the first expansion valve 11 flows into the heat exchanger 2 and absorbs heat to be evaporated to some extent. The gaseous refrigerant flowed out of the heat exchanger 2 flows into the gas-liquid separator 5, passing through the second inlet 42, the mixing section 44 and the diffuser section 45 of the ejector 4. The refrigerant having flowed into the gas-liquid separator 5 does not flow out from the liquid side outlet 5C since the fourth expansion valve 14 is closed, but flows out from the gas side outlet 5B to be sucked into the compressor 1 to be compressed.

Now, the relation between the load and the heating capacity and the relation between the load and the COP concerning the heat pump apparatus 100 will be explained. In here, explanation will be given using an outdoor temperature as an index showing a load.

Figure 9:
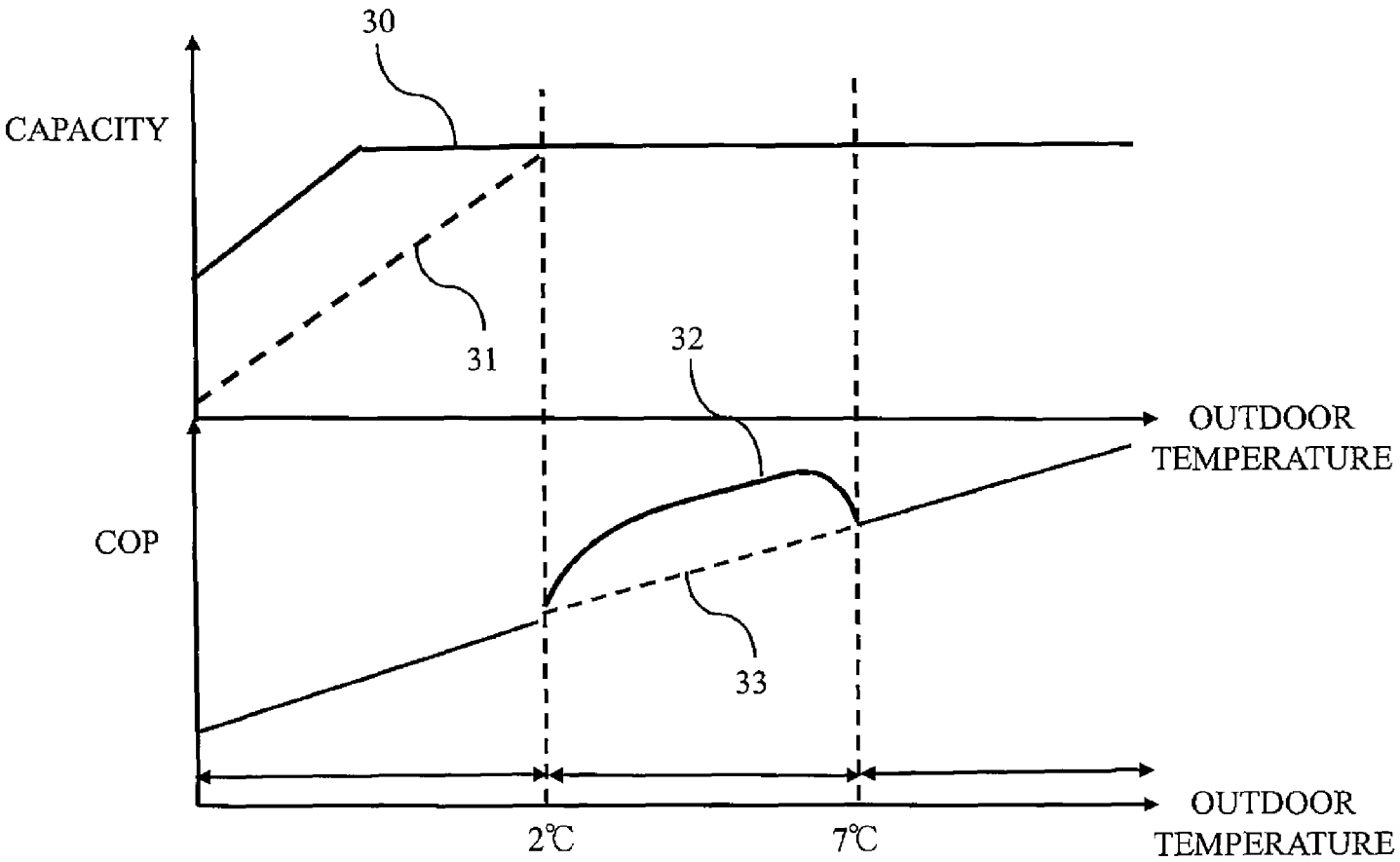
FIG. 9 shows a relation between an outdoor temperature and a heating capacity and a relation between an outdoor temperature and COP concerning the heat pump apparatus 100 according to Embodiment 1.

FIG. 9 shows a relation between an outdoor temperature and a heating capacity and a relation between an outdoor temperature and COP concerning the heat pump apparatus 100 according to Embodiment 1. In FIG. 9, the solid lines show the heating capacity and the COP of the heat pump apparatus 100, and whereas the dashed lines show the heating capacity and the COP of a general heat pump apparatus. The portion where the solid line and the dashed line are overlapped is shown only by the solid line. Therefore, the portion where both the solid line and the dashed line are shown is a portion where there is a difference between a general heat pump apparatus and the heat pump apparatus 100.

That is, concerning COP in the case of the outdoor temperature being higher than or equal to 2° C. and lower than 7° C., there is a difference between the heat pump apparatus generally used and the heat pump apparatus 100 of the present invention, and concerning heating capacity in the case of the outdoor temperature being lower than 2° C., there is also a difference between them.

When the outdoor temperature is higher than or equal to 2° C. and lower than 7° C., the heat pump apparatus 100 performs an ejector aided operation. In the ejector aided operation, as described above, the pressure energy in the decompression process is recovered by the ejector 4. Therefore, the COP (the COP represented by the sign 32 of FIG. 9) of the heat pump apparatus 100 is higher compared with the COP (the COP represented by the sign 33 of FIG. 9) of a general heat pump apparatus.

When the outdoor temperature is lower than 2 degrees, the heat pump apparatus 100 performs an injection operation. In the injection operation, as described above, the refrigerant is injected into the intermediate pressure space of the compressor 1, and the refrigerant flow amount increases. Therefore, the heating capacity (the heating capacity represented by the sign 30 of FIG. 9) of the heat pump apparatus 100 is higher compared with the heating capacity (the heating capacity represented by the sign 31 of FIG. 9) of the general heat pump apparatus.

When the outdoor temperature is higher than or equal to 7° C., the heat pump apparatus 100 performs a simple bypass operation. As described above, the simple bypass operation performs bypassing without using the ejector 4. Therefore, it does not occur that the amount of refrigerant circulated to the heat exchanger 3 which operates as an evaporator becomes insufficient due to a driving force shortage of the ejector 4 caused by a decrease of the load resulting from an increase of the outdoor temperature. Accordingly, the COP does not become lower compared with the general heat pump apparatus.

As described above, the heat pump apparatus 100 can perform a high efficiency and high capacity operation as a whole by performing, depending on the state of the load, switching of the circuit to flow the refrigerant.

In the explanation described above, the control unit 10 controls the expansion valves 11, 12, 13, 14, etc. according to the outdoor temperature at the time of performing a heating operation. The heat pump apparatus 100 herein includes a load detection unit (not shown), by which the outdoor temperature is detected.

In the explanation described above, the control unit 10 controls the expansion valves 11, 12, 13, 14, etc. depending on whether the outdoor temperature at the time of performing a heating operation is lower than 2° C., higher than or equal to 2° C. and lower than 7° C., or higher than or equal to 7° C. However, the temperatures 2° C. and 7° C. are just examples, and it is not limited thereto.

Moreover, in the explanation described above, an outdoor temperature is used as an index for determining a load. However, the index for determining a load is not limited to the outdoor temperature.

The load herein is a required load being a heat amount necessary for making a temperature of fluid, which is heat-exchanged with refrigerant flowing through the main refrigerant circuit 101 in the heat exchanger 2, be a predetermined temperature. That is, the load is a heat amount necessary for letting the temperature of the air in a room be a predetermined temperature in the case of an air conditioning operation, and is a temperature necessary for letting the temperature of the water to be supplied be a predetermined temperature in the case of a hot-water supply operation.

Therefore, the load detection unit may detect, as an index for determining the load, not an outdoor temperature but an evaporating pressure or a temperature of the heat exchanger 3, or may detect a compressor frequency which serves as an index of a refrigerant circulation amount. Moreover, the load detection unit may detect a temperature at the load side, such as a room temperature to be warmed in air conditioning, a supply water temperature, and a feed water temperature, or may detect information at the high pressure side, such as a condensing pressure and a temperature of the heat exchanger 2. The supply water temperature indicates a temperature of liquid such as water after being heated by the heat exchanger 2 when the heat exchanger 2 is a heat exchanger performing a heat exchange between refrigerant and liquid such as water. The feed water temperature indicates a temperature of liquid such as water before being heated by the heat exchanger 2 when the heat exchanger 2 is a heat exchanger performing a heat exchange between refrigerant and liquid such as water.

Then, the control unit 10 may control the expansion valves 11, 12, 13, 14, etc. by judging the size of the load based on these indices.

Moreover, the load detection unit may judge the load by detecting a plurality of indices.

For example, the load detection unit may detect an outdoor temperature and a feed water temperature. In that case, for example, the control unit 10 performs an ejector aided operation when the outdoor temperature is higher than or equal to 2° C. and lower than 7° C. and the feed water temperature is high (for example, higher than or equal to 35° C.). Moreover, the control unit 10 may perform an injection operation when the outdoor temperature is lower than 2° C. or the feed water temperature is low (for example, lower than 35° C.), and perform a simple bypass operation when the outdoor temperature is higher than or equal to 7° C.

Moreover, for example, the load detection unit may detect an outdoor temperature and a compressor frequency. In that case, for example, the control unit 10 may perform an ejector aided operation when the outdoor temperature is higher than or equal to 2° C. and lower than 7° C. and the compressor frequency is large (for example, a frequency being greater than or equal to 90% of the rated capacity of the compressor 1). Moreover, the control unit 10 may perform an injection operation when the outdoor temperature is lower than 2° C. or the compressor frequency is low (for example, a frequency being less than 90% of the rated capacity of the compressor 1), and perform a simple bypass operation when the outdoor temperature is higher than or equal to 7° C.

In any case of whichever index is used for judging the load, when the control unit 10 judges that the load is larger than a first load which has been pre-set, it controls to execute an injection operation. Moreover, when the control unit 10 judges that the load is lower than the first load and larger than a second load which has been set to be lower than the first load, it controls to execute an ejector aided operation. Moreover, when the control unit 10 judges that the load is smaller than the second load, it controls to execute a simple bypass operation.

The first load and the second load shall be preset in the memory included in the control unit 10.

Moreover, the control unit 10 may perform controlling to execute an injection operation or a simple bypass operation when, other than the size of the load, the throttle amount of the nozzle section 43 of the ejector 4 is insufficient or superfluous, or the nozzle section 43 of the ejector 4 is occluded by dust, etc. When the ejector 4 is in the state described above, if the operation utilizing the ejector 4 is performed, the efficiency becomes degraded. Then, by performing an injection operation or a simple bypass operation in which refrigerant flows bypassing the ejector 4, the efficiency degradation can be prevented.

As shown in FIG. 3, if the nozzle section 43 of the ejector 4 is a fixed throttle whose throttling amount cannot be adjusted, the amount of throttling of the ejector 4 becomes insufficient or superfluous since the evaporation temperature increases or decreases with the change of the outdoor temperature and the room temperature. Therefore, the load detection unit can detect a state where the amount of throttling of the ejector 4 is insufficient or superfluous by detecting an outdoor temperature and a room temperature. Moreover, the load detection unit can also detect a state where the throttling amount of the ejector 4 is insufficient or superfluous, based on a temperature and a pressure of each part of the refrigerant circuit. Further, the load detection unit may detect a state where the nozzle section 43 of the ejector 4 is occluded, by detecting that the super heat at the outlet of the heat exchanger 3 is higher than a predetermined temperature.

In the explanation described above, the fourth expansion valve 14 is an electronic expansion valve, but it may also be a check valve. When the fourth expansion valve 14 is a check valve, it is necessary to provide, in the pipe connecting the gas-liquid separator 5 and the junction point 22, a throttle mechanism which is connected to the fourth expansion valve 14 in series.

Figure 10:
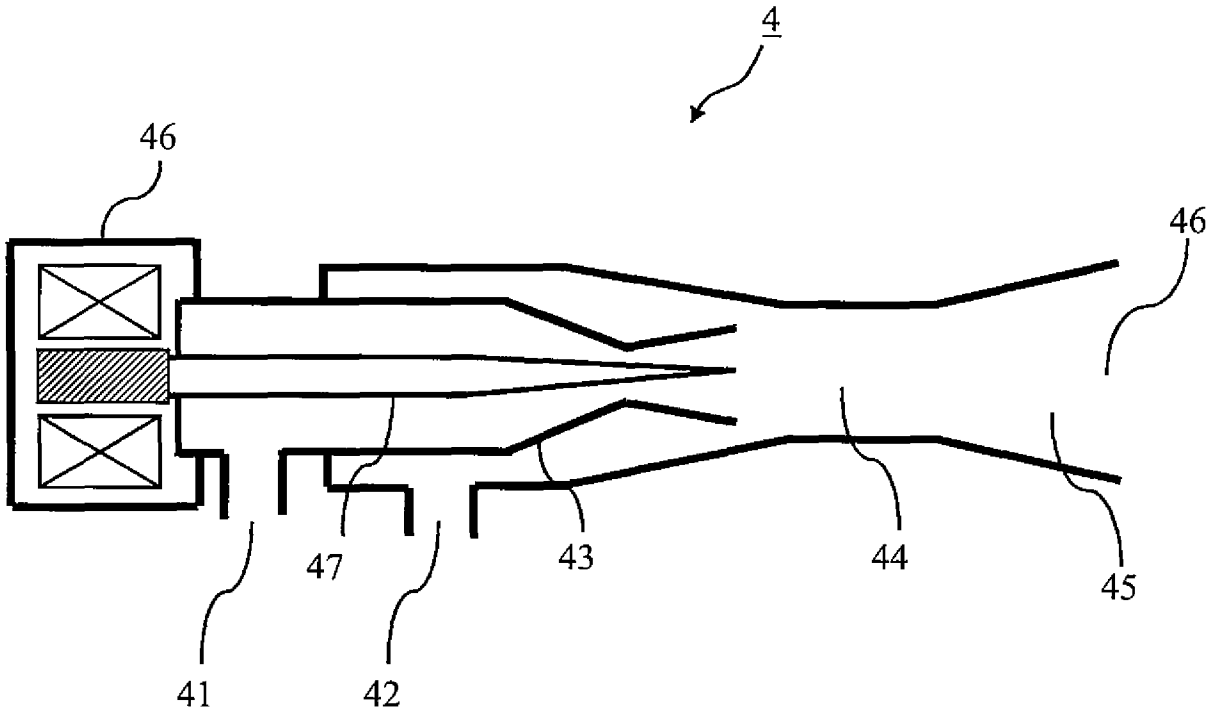
FIG. 10 shows another structure of the ejector 4.

In the above explanation, as shown in FIG. 3, the example of the ejector 4 being a fixed throttle is described. However, as shown in FIG. 10, it is also acceptable that the ejector 4 includes an electromagnetic coil 47 and a needle 48 and controls the flow amount of refrigerant passing through the nozzle section 43 by controlling the electromagnetic coil 47 in order to change the diameter of the nozzle section 43 by using the needle 48.

In the above explanation, the flow amount of refrigerant flowing in through the first inlet 41 of the ejector 4 is adjusted by controlling the opening degree of the third expansion valve 13. However, in the case that the flow amount of refrigerant passing through the nozzle section 43 can be controlled with the needle 48 by controlling the electromagnetic coil 47, it is also acceptable to adjust the flow amount of the refrigerant flowing in through the first inlet 41 of the ejector 4 by controlling the electromagnetic coil 47.

Moreover, in the above explanation, R410 and propane are cited as examples of the refrigerant. However, the refrigerant is not limited to propane. It is also acceptable to use a refrigerant of HFO (hydro fluoro olefin) system having low GWP (Global Warming Potential) or a mixed refrigerant produced by mixing refrigerants of HFO system. These refrigerants are flammable or low flammable. However, in the case that the heat exchanger 2 is provided in the outdoor unit, a flammable refrigerant does not flow into the space at the interior side, and thereby it can be used safely.

Embodiment 2

The heat pump apparatus 100 according to Embodiment 1 performs an ejector aided operation when the outdoor temperature is higher than or equal to 2° C. and lower than 7° C., and performs an injection operation without using the ejector 4 when the outdoor temperature is lower than 2° C. That is, in Embodiment 1, the operation utilizing the ejector 4 and the injection operation are alternatively switched according to the outdoor temperature.

The heat pump apparatus 100 according to Embodiment 2 newly sets up a reference temperature B ° C., which is lower than 2° C., as the outdoor temperature. When the outdoor temperature is higher than or equal to B ° C. and lower than 2° C., the heat pump apparatus 100 performs a compound operation which utilizes the ejector 4 and makes the refrigerant flow also to the second sub-refrigerant circuit 103. Moreover, the heat pump apparatus 100 performs an injection operation using no ejector 4 when the outdoor temperature is lower than B ° C.

That is, the control unit 10 included in the heat pump apparatus 100 according to Embodiment 2 controls to execute a compound operation when the load is higher than the first load and smaller than a third load that has been set higher than the first load. Moreover, the control unit 10 controls to execute an injection operation when the load is larger than the third load.

Figure 11:
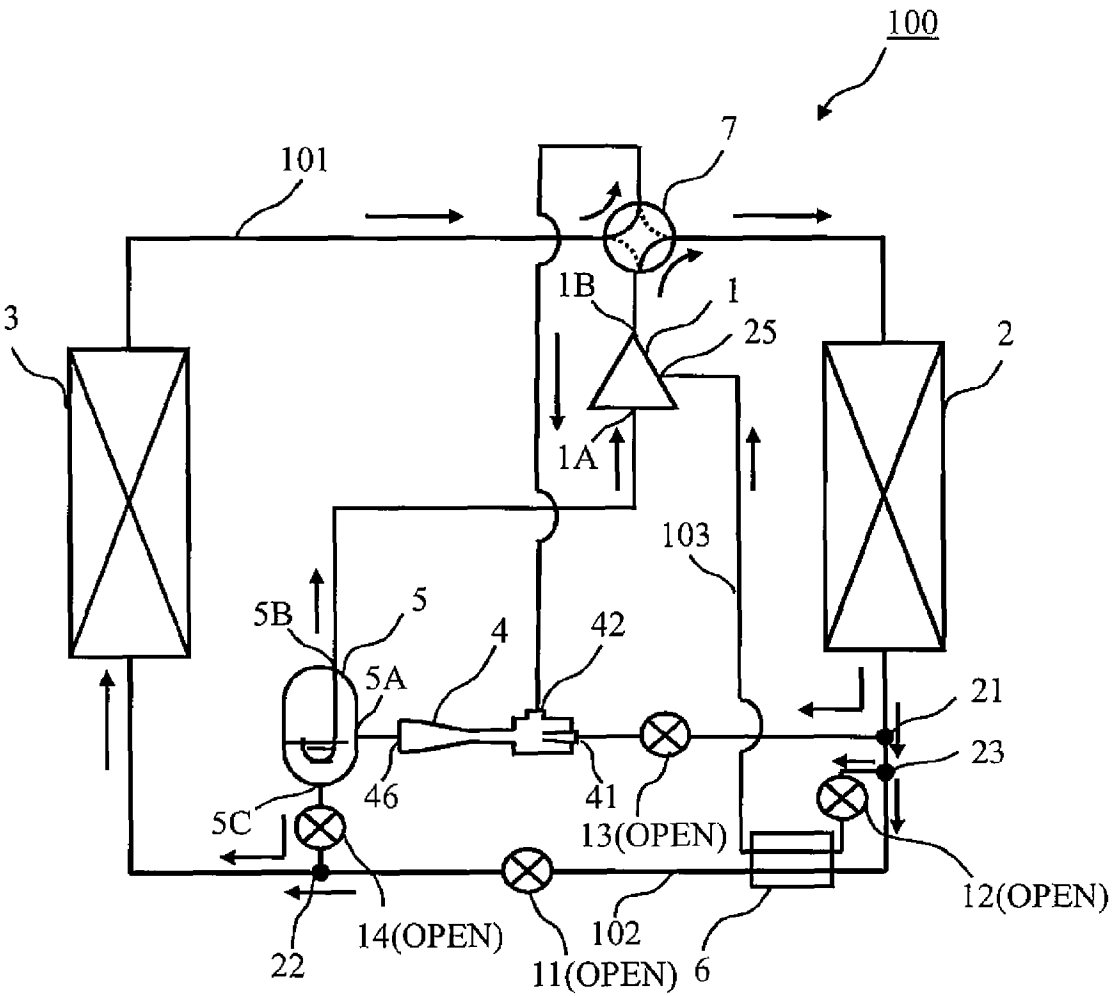
FIG. 11 shows a flow of refrigerant when performing a compound operation.

FIG. 11 shows the flow of the refrigerant in the case of performing a compound operation.

When performing the compound operation, the control unit 10 sets the opening degrees of the first expansion valve 11, the second expansion valve 12, the third expansion valve 13, and the fourth expansion valve 14 to be open larger than a predetermined opening degree so that a suitable amount of refrigerant may flow therethrough. Moreover, the control unit 10 sets the four-way valve 7 in the first flow path (the flow path shown in the solid line in the four-way valve 7 of FIG. 11).

The high-temperature high-pressure gaseous refrigerant discharged from the compressor 1 radiates heat and condenses in the heat exchanger 2 so as to be liquefied to be a medium-temperature high-pressure liquid refrigerant, whose part flows into the ejector 4 from the branch point 21 and the rest flows into the sub-refrigerant circuits 102 and 103. A part of the refrigerant which has flowed into the sub-refrigerant circuits 102 and 103 is distributed, at the branch point 23, to the first sub-refrigerant circuit 102 and the rest is distributed to the second sub-refrigerant circuit 103. That is, the refrigerant flows through all the circuits.

The heat pump apparatus 100 according to Embodiment 2, as well as the heat pump apparatus 100 according to Embodiment 1, performs an operation utilizing the ejector 4 when the outdoor temperature is higher than or equal to 2° C. and lower than 7° C. and thus the load is about medium. Moreover, the heat pump apparatus 100 performs a simple bypass operation when the outdoor temperature is higher than or equal to 7° C. and thus the load is small. Moreover, the heat pump apparatus 100 performs an injection operation using no ejector 4 when the outdoor temperature is lower than B ° C.

Figure 12:
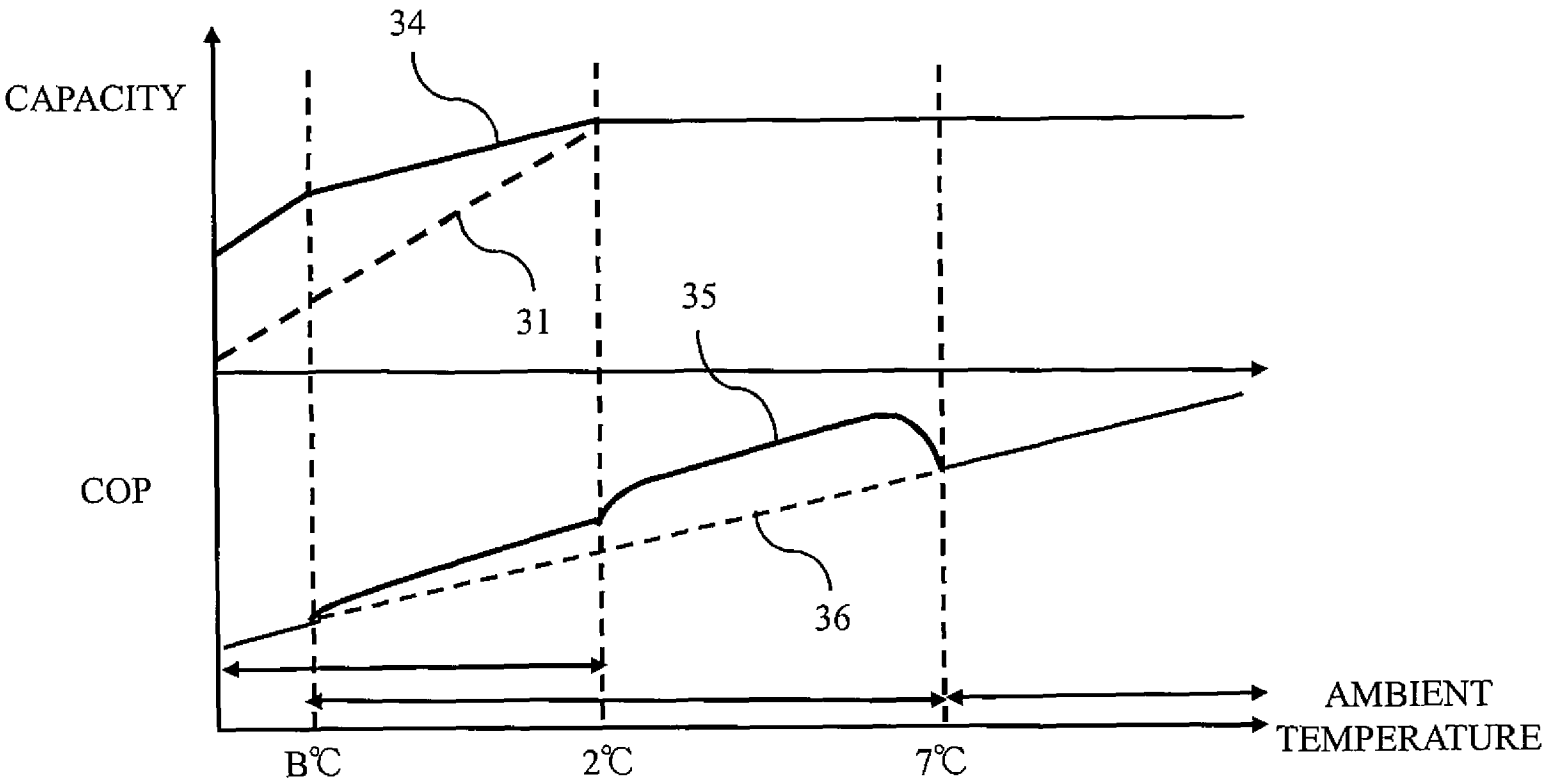
FIG. 12 shows a relation between an outdoor temperature and a heating capacity and a relation between an outdoor temperature and COP concerning the heat pump apparatus 100 according to Embodiment 2.

FIG. 12 shows a relation between an outdoor temperature and a heating capacity and a relation between an outdoor temperature and COP concerning the heat pump apparatus 100 according to Embodiment 2. Regarding the relation between an outdoor temperature and a heating capacity and the relation between an outdoor temperature and COP shown in FIG. 12, only a part differing from FIG. 9 will now be explained.

When the outdoor temperature is higher than or equal to B ° C. and lower than 2° C., the heat pump apparatus 100 performs a compound operation. Therefore, the heating capacity (the heating capacity represented by the sign 34 in FIG. 12) of the heat pump apparatus 100 according to Embodiment 2 is higher compared with the heating capacity (the heating capacity represented by the sign 31 in FIG. 12) of a general heat pump apparatus. However, the heating capacity of the heat pump apparatus 100 according to Embodiment 2 is a little lower compared with the heating capacity (the heating capacity represented by the sign 30 of FIG. 9) of the heat pump apparatus 100 according to Embodiment 1.

On the other hand, when the outdoor temperature is higher than or equal to B ° C. and lower than 2° C., COP (COP represented by the sign 35 in FIG. 12) of the heat pump apparatus 100 according to Embodiment 2 is higher compared with COP (COP represented by the 36 in FIG. 12) of a general heat pump apparatus. That is, COP of the heat pump apparatus 100 according to Embodiment 2 is higher compared with COP of the heat pump apparatus 100 according to Embodiment 1.

Thus, compared with the heat pump apparatus 100 according to Embodiment 1, the heat pump apparatus 100 according to Embodiment 2 can perform an operation balanced between the capacity and the efficiency when the load is large.

As well as Embodiment 1, the index for judging the load may be not only the outdoor temperature but also other index.

To sum up the above, the heat pump apparatus 100 is characterized in that it includes a refrigerating cycle apparatus including a refrigerant circuit which is configured by, circularly connecting in series by piping, a compressor, a radiator that radiates heat to cool refrigerant discharged from the compressor, an ejector that decompresses and expands the refrigerant discharged from the radiator and increases the inlet pressure of the compressor by converting the expansion energy to the pressure energy, a gas-liquid separator that separates the refrigerant discharged from the ejector into a gaseous refrigerant and a liquid refrigerant, and an evaporator that evaporates the liquid refrigerant separated from the gas-liquid separator, and a sub-refrigerant circuit in which the liquid refrigerant outlet portion of the gas-liquid separator and the high-pressure side inlet portion of the ejector are connected by piping through a first throttling device, wherein a sub-cooler is provided between the high-pressure side upstream portion and the first throttling device in the sub-refrigerant circuit.

Moreover, the heat pump apparatus 100 is characterized in that there is provided an on-off valve at the liquid refrigerant outlet portion of the gas-liquid separator.

Furthermore, it is characterized in that the on-off valve is a check valve.

Furthermore, it is characterized in that the cold heat source of the sub-cooler is a low-pressure two phase refrigerant obtained by decompressing a part of the refrigerant of the sub-refrigerant circuit.

Moreover, it is characterized in that the refrigerant evaporated by the sub-cooler is bypassed to the intermediate pressure portion, which is in the middle of compression, of the compressor.

It is characterized in that the refrigerant circuit and the sub-refrigerant circuit are switched according to an outdoor temperature.

It is characterized in that the outdoor temperature includes a first outdoor temperature being comparatively high and a second outdoor temperature being comparatively low.

It is characterized in that the sub-cooler is not used when higher than or equal to the first outdoor temperature, and the sub-cooler is used when lower than the first outdoor temperature.

It is characterized in that the ejector is not used when higher than or equal to the second outdoor temperature, and the ejector is used when higher than or equal to the first outdoor temperature and lower than the second outdoor temperature.

REFERENCE SIGNS LIST

1 Compressor, 1A Suction port, 1B Discharge port, 2 Heat exchanger, 3 Heat exchanger, 4 Ejector, 5 Gas-liquid separator, 5A Inlet, 5B Gas side outlet, 5C Liquid side outlet, 6 Third heat exchanger, 7 Four-way valve, 8 Fourth heat exchanger, 10 Control unit, 11 First expansion valve, 12 Second expansion valve, 13 Third expansion valve, 14 Fourth expansion valve, 15 and 16 Electromagnetic valves, 17 and 18 Capillary tubes, 21 and 23 Branch points, 22 and 24 Junction points, 25 Injection pipe, 41 First inlet, 42 Second inlet, 43 Nozzle section, 44 Mixing section, 45 Diffuser section, 46 Outlet, 47 Electromagnetic coil, 48 Needle, 100 Heat pump apparatus, 101 Main refrigerant circuit, 102 First sub-refrigerant circuit, 103 Second sub-refrigerant circuit

The invention claimed is:

1. A heat pump apparatus, comprising:

a main refrigerant circuit, through which refrigerant circulates, configured by connecting a discharge side of a compressor and a first heat exchanger by piping, the first heat exchanger and a first inlet of an ejector by piping, an outlet of the ejector and an inlet of a gas-liquid separator by piping, a gas side outlet of the gas-liquid separator and a suction side of the compressor by piping, a liquid side outlet of the gas-liquid separator and a second heat exchanger by piping, and the second heat exchanger and a second inlet of the ejector by piping;

a first sub-refrigerant circuit configured by connecting by piping a first connection point between the first heat exchanger and the first inlet of the ejector in the main refrigerant circuit to a second connection point between the liquid side outlet of the gas-liquid separator and the second heat exchanger in the main refrigerant circuit, and being provided with a first expansion mechanism in the piping;

a second sub-refrigerant circuit that makes a part of refrigerant flowing through a third connection point between the first heat exchanger and the first inlet of the ejector in the main refrigerant circuit bypass the ejector so as to flow into the compressor, and is provided with a second expansion mechanism;

a third heat exchanger that performs heat exchange between refrigerant flowing between the first connection point and the first expansion mechanism in the first sub-refrigerant circuit and refrigerant after passing through the second expansion mechanism in the second sub-refrigerant circuit;

a control valve that controls an amount of refrigerant which has flowed out of the first heat exchanger and is to be flowed into the first inlet of the ejector; and a control unit that controls an opening degree of the control valve, an opening degree of the first expansion mechanism, and an opening degree of the second expansion mechanism, according to a required load being a heat amount necessary for making a temperature of fluid, which is heat-exchanged with refrigerant flowing through the first heat exchanger, be a predetermined temperature, and when the required load is lower than or equal to a first load which has been preset and larger than a second load which has been set to be lower than the first load, the control unit controls the opening degree of the control valve to be larger than a predetermined opening degree, and the opening degree of the first expansion mechanism and the opening degree of the second expansion mechanism to be smaller than the predetermined opening degree.

2. The heat pump apparatus according to claim 1, wherein the second sub-refrigerant circuit is an injection circuit that connects from the third connection point to an injection pipe provided in the compressor, and injects, through the injection pipe, refrigerant flowing through the third connection point into an intermediate pressure space where refrigerant sucked in from the main refrigerant circuit turns into an intermediate state of compression in the compressor.

3. The heat pump apparatus according to claim 1, wherein, when the required load is larger than the first load, the control unit controls the opening degree of the control valve to be smaller than the predetermined opening degree, and the opening degree of the first expansion mechanism and the opening degree of the second expansion mechanism to be larger than the predetermined opening degree.

4. The heat pump apparatus according to claim 1, wherein, when the required load is lower than or equal to the second load, the control unit controls the opening degree of the control valve and the opening degree of the second expansion mechanism to be smaller than the predetermined opening degree, and the opening degree of the first expansion mechanism to be larger than the predetermined opening degree.

5. The heat pump apparatus according to claim 1, wherein, when the required load is larger than the first load and lower than or equal to a third load which has been set to be higher than the first load, the control unit controls the opening degree of the control valve, the opening degree of the first expansion mechanism, and the opening degree of the second expansion mechanism to be larger than a predetermined opening degree, and when the required load is larger than the third load, the control unit controls the opening degree of the control valve to be smaller than the predetermined opening degree, and the opening degree of the first expansion mechanism and the opening degree of the second expansion mechanism to be larger than the predetermined opening degree.

6. The heat pump apparatus according to claim 1, wherein the control valve is an on-off valve provided between the first connection point and the first inlet of the ejector.

7. The heat pump apparatus according to claim 1, wherein the ejector includes a nozzle section that decompresses, accelerates, and jets refrigerant flowed in through the first inlet, and a pressure boosting section that boosts pressure by mixing the refrigerant jetted by the nozzle section and refrigerant sucked in through the second inlet, and wherein the control valve is a throttle mechanism that adjusts an opening degree of the nozzle section.

8. The heat pump apparatus according to claim 1, wherein, in the main refrigerant circuit, an on-off valve is provided between the liquid side outlet of the gas-liquid separator and the second connection point.

9. The heat pump apparatus according to claim 8, wherein the on-off valve is a check valve that allows a flow going from the liquid side outlet of the gas-liquid separator to the second connection point, and does not allow a flow going from the second connection point to the liquid side outlet of the gas-liquid separator.

10. A heat pump apparatus, comprising:

a main refrigerant circuit, through which refrigerant circulates, configured by connecting a discharge side of a compressor and a first heat exchanger by piping, the first heat exchanger and a first inlet of an ejector by piping, an outlet of the ejector and an inlet of a gas-liquid separator by piping, a gas side outlet of the gas-liquid separator and a suction side of the compressor by piping, a liquid side outlet of the gas-liquid separator and a second heat exchanger by piping, and the second heat exchanger and a second inlet of the ejector by piping;

a first sub-refrigerant circuit configured by connecting by piping a first connection point between the first heat exchanger and the first inlet of the ejector in the main refrigerant circuit to a second connection point between the liquid side outlet of the gas-liquid separator and the second heat exchanger in the main refrigerant circuit, and being provided with a first expansion mechanism in the piping;

a second sub-refrigerant circuit that makes a part of refrigerant flowing through a third connection point between the first heat exchanger and the first inlet of the ejector in the main refrigerant circuit bypass the ejector so as to flow into the compressor, and is provided with a second expansion mechanism;

a third heat exchanger that performs heat exchange between refrigerant flowing between the first connection point and the first expansion mechanism in the first sub-refrigerant circuit and refrigerant after passing through the second expansion mechanism in the second sub-refrigerant circuit;

a control valve that controls an amount of refrigerant which has flowed out of the first heat exchanger and is to be flowed into the first inlet of the ejector; and a control unit that controls an opening degree of the control valve, an opening degree of the first expansion mechanism, and an opening degree of the second expansion mechanism, according to a required load being a heat amount necessary for making a temperature of fluid, which is heat-exchanged with refrigerant flowing through the first heat exchanger, be a predetermined temperature, and when the required load is larger than a first load which has been preset, the control unit controls the opening degree of the control valve to be smaller than a predetermined opening degree, and the opening degree of the first expansion mechanism and the opening degree of the second expansion mechanism to be larger than the predetermined opening degree.

11. A heat pump apparatus, comprising:

a main refrigerant circuit, through which refrigerant circulates, configured by connecting a discharge side of a compressor and a first heat exchanger by piping, the first heat exchanger and a first inlet of an ejector by piping, an outlet of the ejector and an inlet of a gas-liquid separator by piping, a gas side outlet of the gas-liquid separator and a suction side of the compressor by piping, a liquid side outlet of the gas-liquid separator and a second heat exchanger by piping, and the second heat exchanger and a second inlet of the ejector by piping;

a first sub-refrigerant circuit configured by connecting by piping a first connection point between the first heat exchanger and the first inlet of the ejector in the main refrigerant circuit to a second connection point between the liquid side outlet of the gas-liquid separator and the second heat exchanger in the main refrigerant circuit, and being provided with a first expansion mechanism in the piping;

a second sub-refrigerant circuit that makes a part of refrigerant flowing through a third connection point between the first heat exchanger and the first inlet of the ejector in the main refrigerant circuit bypass the ejector so as to flow into the compressor, and is provided with a second expansion mechanism;

a third heat exchanger that performs heat exchange between refrigerant flowing between the first connection point and the first expansion mechanism in the first sub-refrigerant circuit and refrigerant after passing through the second expansion mechanism in the second sub-refrigerant circuit;

a control valve that controls an amount of refrigerant which has flowed out of the first heat exchanger and is to be flowed into the first inlet of the ejector; and a control unit that controls an opening degree of the control valve, an opening degree of the first expansion mechanism, and an opening degree of the second expansion mechanism, according to a required load being a heat amount necessary for making a temperature of fluid, which is heat-exchanged with refrigerant flowing through the first heat exchanger, be a predetermined temperature, and when the required load is lower than or equal to a second load which has been preset, the control unit controls the opening degree of the control valve and the opening degree of the second expansion mechanism to be smaller than a predetermined opening degree, and the opening degree of the first expansion mechanism to be larger than the predetermined opening degree.

12. A heat pump apparatus, comprising:

a main refrigerant circuit, through which refrigerant circulates, configured by connecting a discharge side of a compressor and a first heat exchanger by piping, the first heat exchanger and a first inlet of an ejector by piping, an outlet of the ejector and an inlet of a gas-liquid separator by piping, a gas side outlet of the gas-liquid separator and a suction side of the compressor by piping, a liquid side outlet of the gas-liquid separator and a second heat exchanger by piping, and the second heat exchanger and a second inlet of the ejector by piping;

a first sub-refrigerant circuit configured by connecting by piping a first connection point between the first heat exchanger and the first inlet of the ejector in the main refrigerant circuit to a second connection point between the liquid side outlet of the gas-liquid separator and the second heat exchanger in the main refrigerant circuit, and being provided with a first expansion mechanism in the piping;

a second sub-refrigerant circuit that makes a part of refrigerant flowing through a third connection point between the first heat exchanger and the first inlet of the ejector in the main refrigerant circuit bypass the ejector so as to flow into the compressor, and is provided with a second expansion mechanism;

a third heat exchanger that performs heat exchange between refrigerant flowing between the first connection point and the first expansion mechanism in the first sub-refrigerant circuit and refrigerant after passing through the second expansion mechanism in the second sub-refrigerant circuit;

a control valve that controls an amount of refrigerant which has flowed out of the first heat exchanger and is to be flowed into the first inlet of the ejector; and a control unit that controls an opening degree of the control valve, an opening degree of the first expansion mechanism, and an opening degree of the second expansion mechanism, according to a required load being a heat amount necessary for making a temperature of fluid, which is heat-exchanged with refrigerant flowing through the first heat exchanger, be a predetermined temperature, and when the required load is larger than a first load which has been preset and lower than or equal to a third load which has been set to be higher than the first load, the control unit controls the opening degree of the control valve, the opening degree of the first expansion mechanism, and the opening degree of the second expansion mechanism to be larger than a predetermined opening degree, and when the required load is larger than the third load, the control unit controls the opening degree of the control valve to be smaller than the predetermined opening degree, and the opening degree of the first expansion mechanism and the opening degree of the second expansion mechanism to be larger than the predetermined opening degree.

* * * * *